US012313378B2

(12) United States Patent
Carter et al.

(10) Patent No.: US 12,313,378 B2
(45) **Date of Patent: *May 27, 2025**

(54) KINEMATIC MOUNT FOR A FIREARM

(71) Applicant: Agency Arms, LLC, Caldwell, ID (US)

(72) Inventors: Donald G. R. Carter, Caldwell, ID (US); Randy Niswander, Caldwell, ID (US)

(73) Assignee: Agency Arms, LLC, Caldwell, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/588,472

(22) Filed: Feb. 27, 2024

(65) Prior Publication Data

US 2024/0200910 A1 Jun. 20, 2024

Related U.S. Application Data

(63) Continuation of application No. 18/046,176, filed on Oct. 13, 2022, now Pat. No. 11,933,584, which is a continuation of application No. 17/399,409, filed on Aug. 11, 2021, now Pat. No. 11,561,068.

(60) Provisional application No. 63/068,919, filed on Aug. 21, 2020.

(51) Int. Cl.
*F41G 11/00* (2006.01)

(52) U.S. Cl.
CPC ..... *F41G 11/008* (2013.01); *F41G 11/003* (2013.01)

(58) Field of Classification Search
CPC .... F41G 11/001; F41G 11/003; F41G 11/004; F41G 11/005; F41G 11/006; F41G 11/007; F41G 11/008; F41G 1/387; F41C 27/00
See application file for complete search history.

(56) References Cited

U.S. PATENT DOCUMENTS 2,115,618 A * 4/1938 Carl ..... F41G 11/008 42/16
2,338,200 A * 1/1944 Patterson ..... F41G 11/008 248/229.1
2,385,176 A * 9/1945 White ..... F41G 11/008 42/128
2,451,266 A * 10/1948 Whittemore ..... F41G 11/008 42/16

(Continued)

FOREIGN PATENT DOCUMENTS

CN 215810465 U * 2/2022
CN 116164585 A * 5/2023

(Continued)

*Primary Examiner* — Gabriel J. Klein
(74) *Attorney, Agent, or Firm* — Eversheds Sutherland (US) LLP

(57) ABSTRACT

A kinematic mount assembly is provided. The kinematic mount assembly includes a fixed mount and a pivot mount. The fixed mount and pivot mount together have a plurality of protrusions and recesses to guide the mounts into a repeatable position when rotating from an opened to a closed position. The protrusions may be semispherical balls and the recesses may be gothic-arch shaped. The pivot mount and fixed mount may be coupled by a pivot pin and rotate about the pivot pin. The pivot mount may contain holes configured to mount an accessory. A latch assembly may hold the fixed mount and pivot mount closed until the latch is actuated, usually by a switch, to allow the system to open.

20 Claims, 5 Drawing Sheets

(56) References Cited

U.S. PATENT DOCUMENTS 2,529,801 A * 11/1950 Fisk ..... F41G 11/008 108/45
2,545,419 A * 3/1951 Williams ..... F41G 11/006 248/316.1
2,710,453 A * 6/1955 Beverly ..... F41G 11/008 16/258
2,725,635 A * 12/1955 Cline ..... F41G 11/008 42/128
2,773,310 A * 12/1956 Bircher ..... F41G 11/008 42/136
2,942,346 A * 6/1960 Staubach ..... F41G 11/007 42/127
3,178,823 A * 4/1965 Lipski ..... F41G 1/38 42/126
4,070,120 A * 1/1978 Bald ..... F16B 5/02 702/150
5,111,587 A * 5/1992 Plank ..... F41G 11/006 D22/110
5,606,818 A * 3/1997 Hardee ..... F41G 11/003 42/127
7,495,849 B2 * 2/2009 Heuser ..... G02B 7/003 359/811
7,908,782 B1 * 3/2011 LaRue ..... F41G 11/008 42/124
8,015,740 B2 * 9/2011 Jamison ..... F41A 21/00 42/2
8,438,773 B2 * 5/2013 Carlson ..... F41G 11/008 42/90
8,572,881 B2 * 11/2013 Samson ..... F41C 27/00 42/106
8,695,477 B2 * 4/2014 Esch ..... F41A 17/42 89/138
8,769,859 B2 * 7/2014 Li ..... F41G 11/001 42/124
8,793,921 B1 * 8/2014 Tonello ..... F41G 11/008 42/125
8,935,875 B2 * 1/2015 Collin ..... F41G 11/003 42/124
9,157,698 B2 * 10/2015 Cosentino ..... F41G 11/006
9,417,034 B1 * 8/2016 Swan ..... F41G 1/17
9,714,737 B2 * 7/2017 Nishikawa ..... F16M 11/041
10,240,901 B1 * 3/2019 Cheng ..... F41A 35/00
10,495,417 B1 * 12/2019 Geissele ..... F41G 11/003
10,627,191 B1 * 4/2020 Fischer ..... F41G 11/008
10,627,192 B1 * 4/2020 Fischer ..... F41G 11/008
10,845,145 B1 * 11/2020 Baskett ..... F41A 15/02
2003/0056417 A1 * 3/2003 Horton ..... F41G 11/007 42/124
2004/0000083 A1 * 1/2004 Grant, Jr. ..... F41G 11/003 42/112
2004/0065793 A1 * 4/2004 Shelef ..... F16M 11/041 248/181.1
2006/0016061 A1 * 1/2006 Shelef ..... F02B 77/00 248/562
2006/0054767 A1 * 3/2006 Kemeny ..... F16M 11/041 248/346.01
2006/0162227 A1 * 7/2006 Samson ..... F41G 11/008 42/148
2010/0251591 A1 * 10/2010 Burt ..... F41A 17/42 42/70.01
2011/0185618 A1 * 8/2011 Jamison ..... F41C 23/06 42/75.03
2011/0296732 A1 * 12/2011 Carlson ..... F41G 11/008 42/90
2013/0036650 A1 * 2/2013 Larue ..... F41G 11/003 42/148
2013/0305584 A1 * 11/2013 Cosentino ..... F41C 27/00 29/428
2014/0013644 A1 * 1/2014 Trapp ..... F41G 11/003 42/90
2015/0316354 A1 * 11/2015 Cheng ..... F41C 27/00 42/90
2015/0369419 A1 * 12/2015 Nishikawa ..... F16M 11/22 248/583
2016/0025259 A1 * 1/2016 Ison ..... F16M 11/041 29/428
2016/0069506 A1 * 3/2016 Shelef ..... F16M 11/22 403/221
2016/0223294 A1 * 8/2016 Bouquet ..... F41G 11/002
2020/0025522 A1 * 1/2020 Zimmer ..... F41G 11/003
2020/0240576 A1 * 7/2020 Erickson ..... F16M 11/08
2021/0223002 A1 * 7/2021 Xiong ..... F41G 11/003
2022/0090880 A1 * 3/2022 Leutzinger ..... F21V 23/0421

FOREIGN PATENT DOCUMENTS

CN 117387422 A * 1/2024
DE 3128848 A1 * 2/1983
DE 10358666 A1 * 8/2004 ..... F41G 11/004
EP 2383537 A1 * 11/2011 ..... F41G 11/001
EP 3553457 A1 * 10/2019 ..... F41G 11/003
GB 1253435 A * 11/1971
KR 20120065177 A * 6/2012
KR 20230027636 A * 2/2023
WO WO-2012027873 A1 * 3/2012 ..... F41G 1/387
WO WO-2013173646 A1 * 11/2013 ..... F41C 27/00

* cited by examiner

KINEMATIC MOUNT FOR A FIREARM

CROSS-REFERENCE TO RELATED APPLICATIONS

This application claims priority to and is a continuation application of U.S. application Ser. No. 18/046,176, filed Oct. 13, 2022, which claims priority to U.S. application Ser. No. 17/399,409, filed Aug. 11, 2021, now U.S. Pat. No. 11,561,068, issued on Jan. 24, 2023, which claims priority to and the benefit of U.S. Provisional Application No. 63/068,919, filed Aug. 21, 2020, which are hereby incorporated by reference herein in their entireties.

TECHNICAL FIELD

The present application relates generally to kinematic mounts for mounting firearm accessories to a firearm.

BACKGROUND

Firearm accessories may be mounted to firearms. Firearm accessories may include sights, optics, lasers, lights, or others. As may be desired from time to time, the configuration of an accessory on a firearm may vary based on personal preference and/or application, requiring the ability to move between multiple positions. As an example, in some configurations, an optic is positioned on top of the firearm. In other configurations, the optic may be positioned on the side of the firearm out of the way. Yet further, in some configurations, the optic can rotate between two or more positions, allowing customization without requiring removal and remounting of a particular optic. However, if a shooter wants to change from one configuration to another, or one optic to another, such change may be difficult, time-consuming, require special tools, and/or not possible. The change to and from differing configurations may require adjustment to calibrate the optic again.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION

Figure 1:
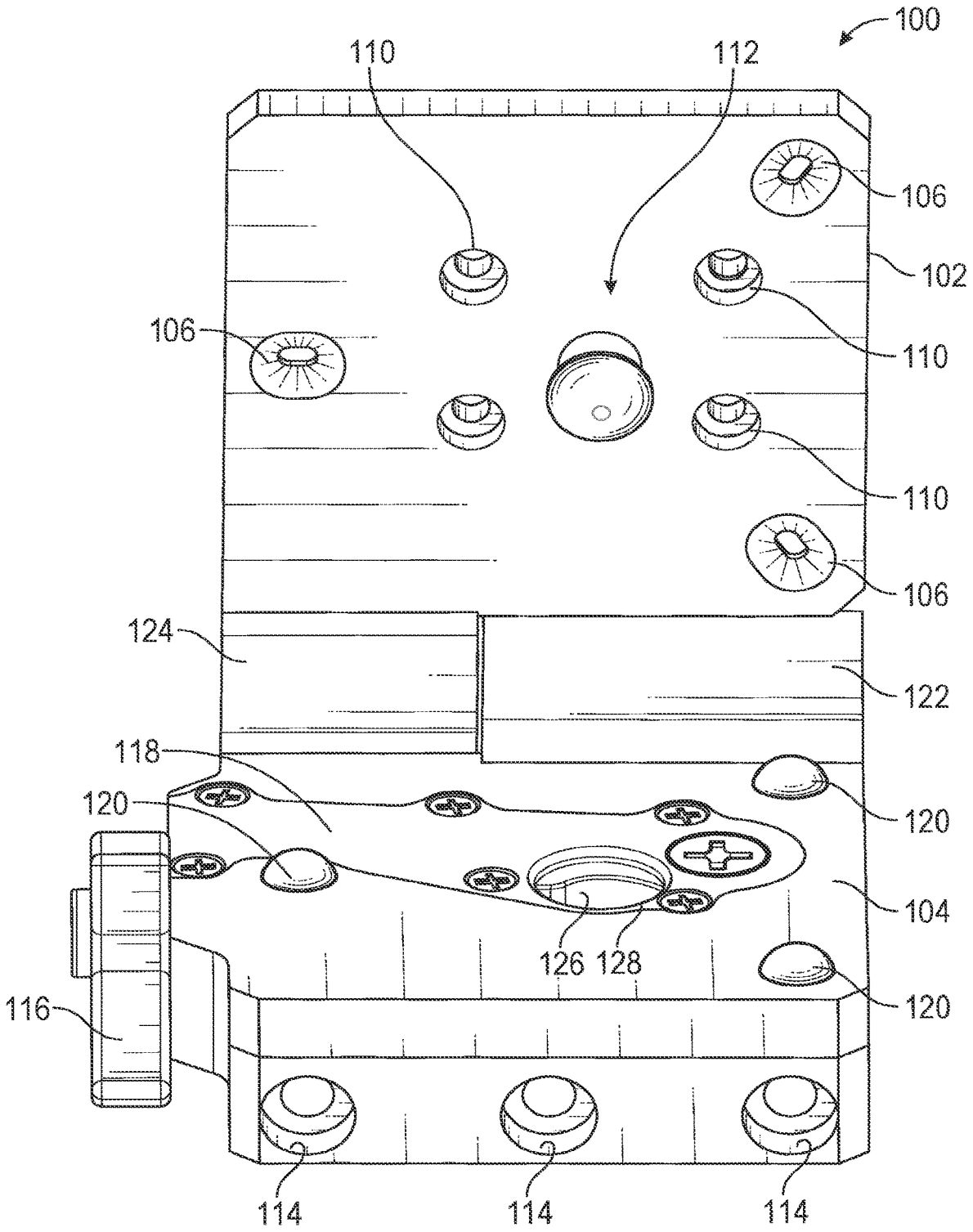
FIG. 1 is a front view of a kinematic mount assembly in an open position according to one or more examples of the disclosure.
Figure 2:
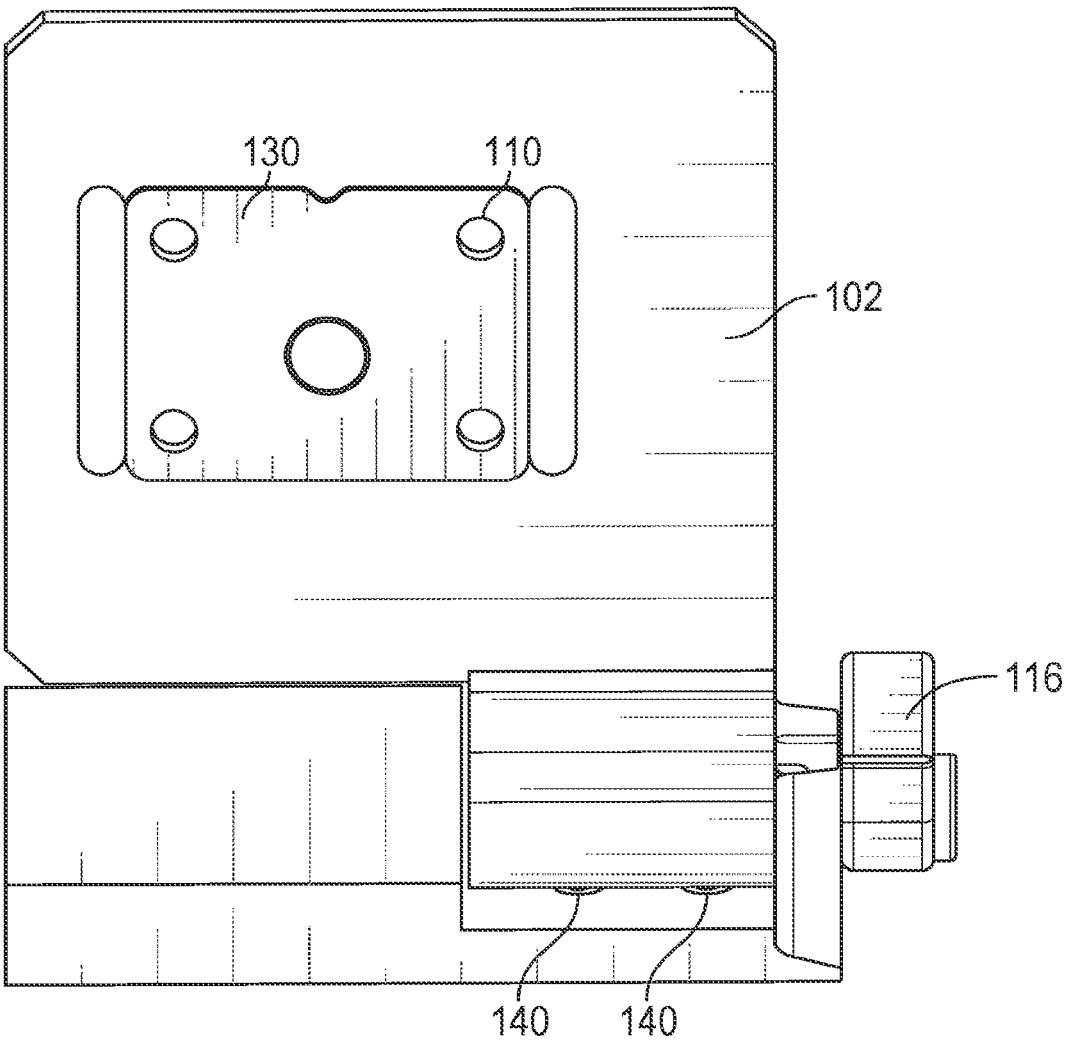
FIG. 2 is a rear view of a kinematic mount assembly in an open position according to one or more examples of the disclosure.
Figure 3:
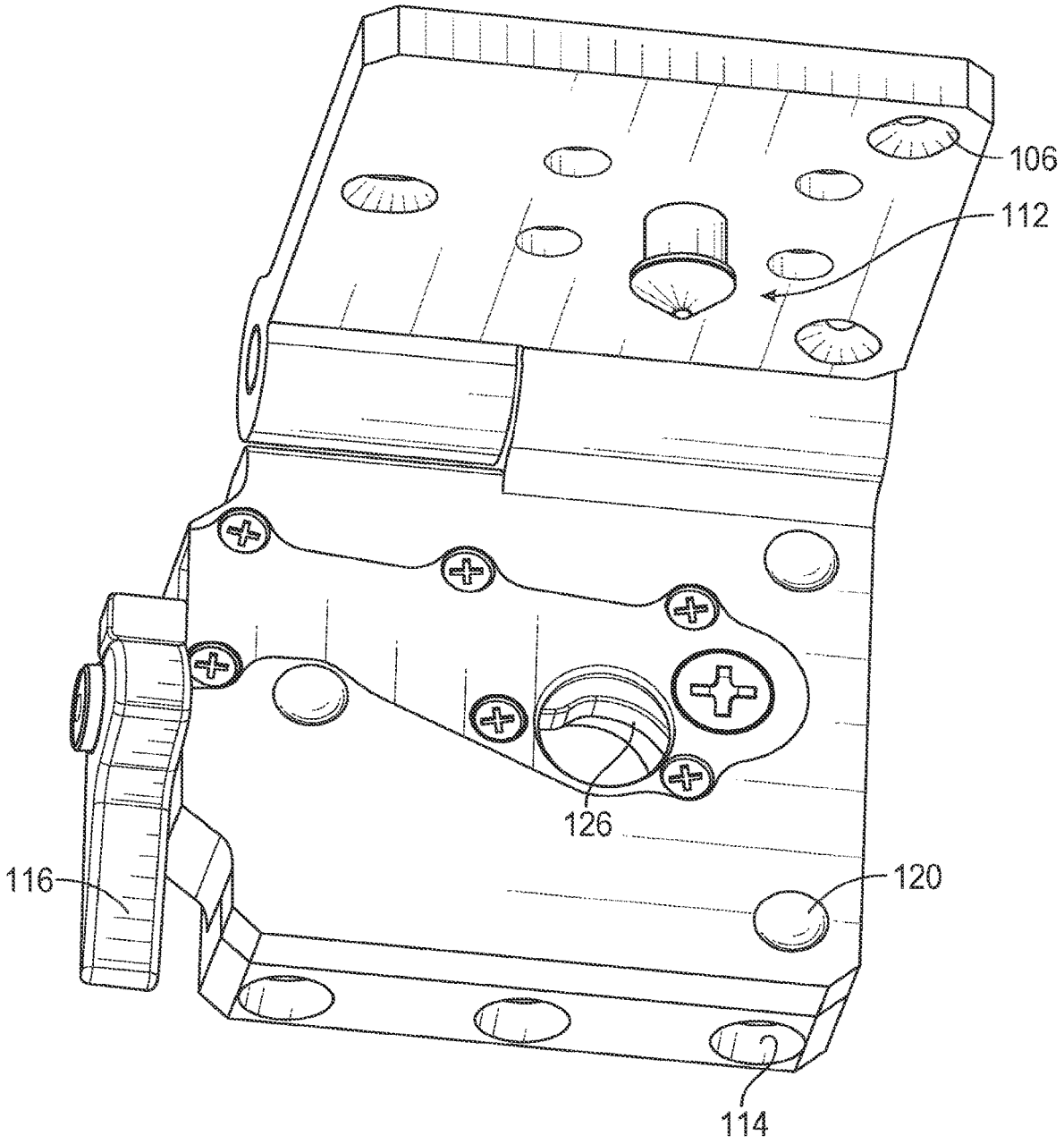
FIG. 3 is a top perspective view of a kinematic mount assembly in an open position according to one or more examples of the disclosure.
Figure 4:
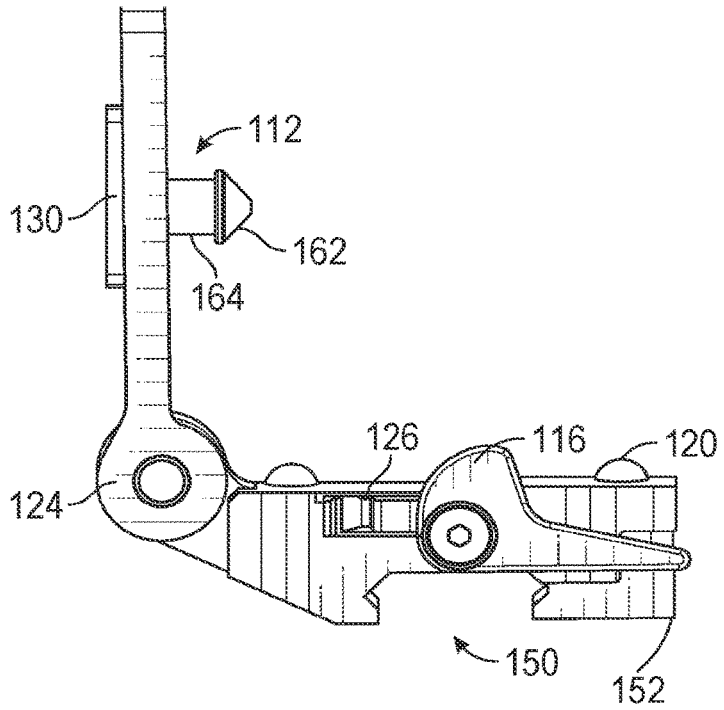
FIG. 4 is a first side view of a kinematic mount assembly in an open position according to one or more examples of the disclosure.
Figure 5:
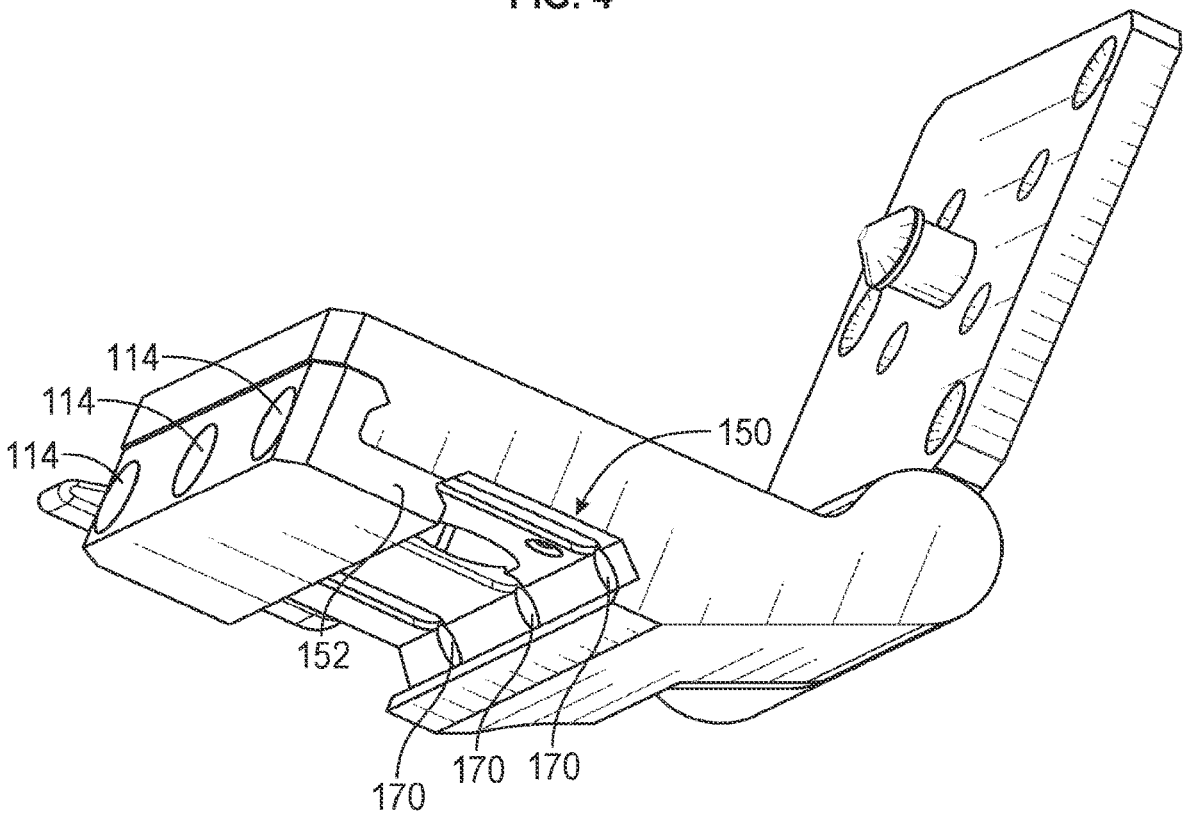
FIG. 5 is a second side perspective view of a kinematic mount assembly in an open position according to one or more examples of the disclosure.

The present disclosure is directed to systems and methods for a mount assembly for a firearm to ensure an accessory attached to a firearm is properly aligned. This mount assembly for a firearm includes both a mounting plate (fixed mount) and a pivot plate (pivot mount) configured to rotate between a closed position (where the plates of the two mounts are parallel) and an open position (where the plates are angled (e.g., perpendicular) to each other). Further, a plurality of protrusions and a plurality of corresponding recesses, arranged on the fixed mount and pivot mount, guide the mount assembly into a repeatable position to ensure consistent alignment. Accessories can be any firearm accessory, specifically accessories that require precision when mounted, such as flashlights, lasers, sights, scopes, or optics.

The mount may include a number of protrusions and corresponding recesses that are collectively configured to move the pivot mount into a repeatable position by guiding the protrusions into the recesses. For example, in some instances, the mount can have tapered protrusions on the pivot mount that mate with recesses on the fixed mount to allow the mount to remain deterministic. In other instances, the fixed mount may include the protrusions that mate with recesses on the pivot mount to allow the mount to remain deterministic. In this configuration, six degrees of freedom (up, down, left, right, backwards, forwards) are handled with the kinematic coupling of the protrusions with the recesses by the recesses adjusting the position of the protrusions on the pivot mount as it closes. Thus, the protrusions act as adjuster pins, and the recesses adjust the protrusions within the recess, shifting the pivot mount into a repeatable position.

The protrusions and recesses can be different shapes and configurations to adjust for contact stress and accuracy. For example, using a gothic arch shaped recess with a semi-spherical ball shaped protrusion decreases Hertzian contact stress between the ball and the recess, and provides increased contact area, life cycles, and pointing repeatability. Another example system uses a cup protrusion and cone recess or lapped sets of cup protrusion and cone recesses.

The design can provide increased accuracy with reduced manufacturing cost, with accuracy up to 0.5 nanometers varying upon materials, protrusion size, coupling effective diameter, clearance in the hinge, and finishes.

The pivot mount may rotate 90° relative to a fixed mount position, and can include a hard stop to prevent over rotation. For example, ball plungers can hold the mount assembly in the open position. A second latch can release the pivot mount from the fixed mount for storage or maintenance. The pivot mount may be permanently pinned to the fixed mount, for example, by a shoe.

The disclosure now will be described more fully hereinafter with reference to the accompanying drawings, in which exemplary embodiments are shown. The concepts discussed herein may, however, be embodied in many different forms and should not be construed as limited to the examples set forth herein; rather, these examples are provided so that this disclosure will be thorough and complete, and will fully convey the scope to those of ordinary skill in the art. Like numbers refer to like, but not necessarily the same or identical, elements throughout.

Kinematic Mount System

FIG. 1 is a front view of a kinematic mount assembly in an open position according to one or more examples of the disclosure. Referring to FIGS. 1-7, in some embodiments, a kinematic mount 100 comprises a fixed mount 104 and a pivot mount 102. The kinematic mount can comprise a number of different materials including steel, titanium, and plastics suitable for use on a firearm accessory, or a combination of these materials. Any suitable material may be used herein. The kinematic mount can include a number of finishes or coatings as well, such as paints, acrylics, or plastics. The materials and finish can affect the repeatability of the positioning of the pivot mount 102 relative to the fixed mount 104.

The pivot mount 102 is the rotatable portion of the kinematic mount 100. The pivot mount 102 comprises an inner and an outer surface. The pivot mount 102 rotates relative to the fixed mount 104. In some embodiments, the pivot mount 102 inner surface can further comprise a plurality of recesses 106 configured to adjust a plurality of protrusions 120 on the fixed mount into a repeatable position. In another embodiment, the pivot mount 102 inner surface can contain the plurality of protrusions 120 instead of the plurality of recesses 106. In another embodiment, the pivot mount 102 inner surface can contain a combination of protrusions 120 and recesses 106, corresponding to a plurality of protrusions and recesses on the fixed mount. In some embodiments, the plurality of recesses 106 are arranged in a triangular shape. In some embodiments, the plurality of recesses comprises three recesses. The triangular shape can help adjust the pivot mount at multiple points by guiding the protrusions 120 into a repeatable position. The pivot mount 102 outer surface can further comprise holes 110 for mounting an accessory. These holes 110 may or may not extend from the pivot mount 102 outer surface through the pivot mount 102 inner surface. The pivot mount 102 outer surface can also comprise a plate 130 to assist with mounting an accessory thereupon. The holes 110 for mounting an accessory can align with holes in the plate 130. The pivot mount 102 can further comprise a pivot mount slot 124. The pivot mount 102 can be stopped from rotating more than a set amount of degrees by adding a stop internally and/or externally of the pivot mount slot 124. The pivot mount 102 further comprises a latch pin 112. The pivot mount 102 is coupled to a fixed mount 104.

The fixed mount 104 is the fixed portion of the kinematic mount system. The fixed mount 104 is configurable to be attached onto the rail or other extension of a firearm. The fixed mount 104 comprises an inner surface, outer surface, left side, right side, front, and back. In some embodiments, the fixed mount 104 comprises a plurality of protrusions 120 while the pivot mount comprises a plurality of recesses. In another embodiment, the fixed mount 104 can contain a combination of protrusions 120 and recesses 106. In some embodiments, the plurality of protrusions or the combination of protrusions and recesses are arranged in a triangular shape. In some embodiments, the plurality of protrusions comprises three protrusions. The fixed mount can further comprise a fixed mount slot 122. The fixed mount 104 can also further comprise a latch plate on the inner surface of the fixed mount 104. The fixed mount 104 can further comprise an aperture 128 on the inner surface of the fixed mount. This aperture 128 may or may not extend from the inner surface of the fixed mount 104 through to the outer surface of the fixed mount 104. The fixed mount 104 may comprise a latch 126 covered by a latch plate 118. The fixed mount 104 may also comprise a switch 126 or switches on the left and/or right side configured to actuate the latch. The fixed mount 104 can also comprises a mounting slot 150 on the outer surface. The fixed mount 104 can comprise a moveable extension 152 on the front side of the fixed mount. The fixed mount 104 may comprise one or a plurality of cavities 114 that may be part of the moveable extension 152 of the fixed mount. These cavities 114 align with bores 170 on the rear side of the fixed mount 104, opposite the mounting slot 150 from the slots 114. The fixed mount 104 is rotatably coupled to the pivot mount 102 by a pin assembly that is inserted into a first slot of the pivot mount 124 and a first slot of the fixed mount 122, such that the mounts 102 and, 104 are rotatable around the pin.

Figure 6:
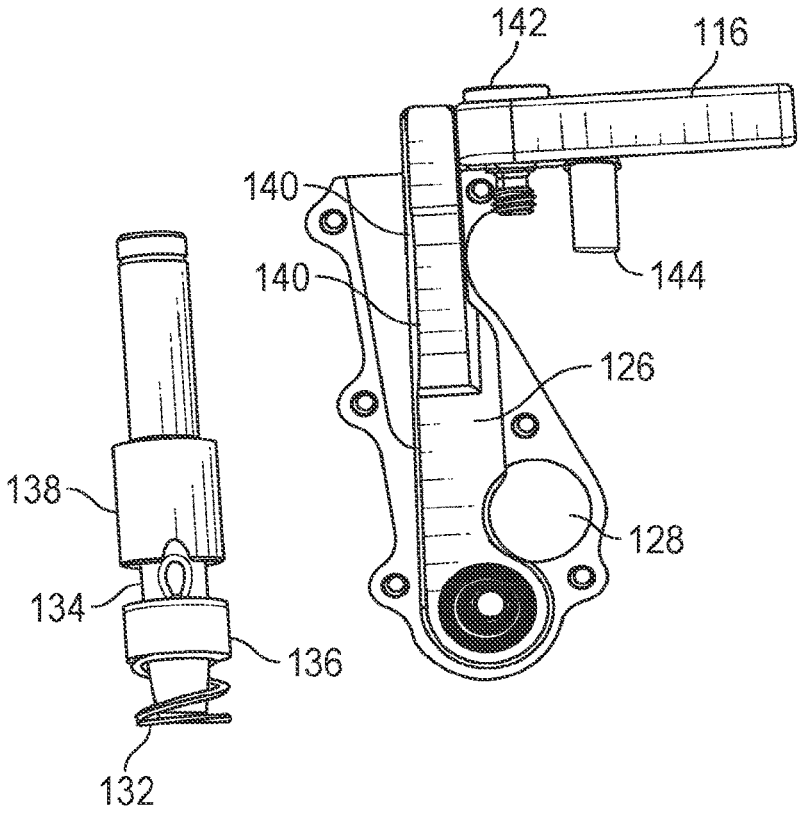
FIG. 6 is a bottom view of a kinematic mount assembly hinge and latch system according to one or more examples of the disclosure.
Figure 7:
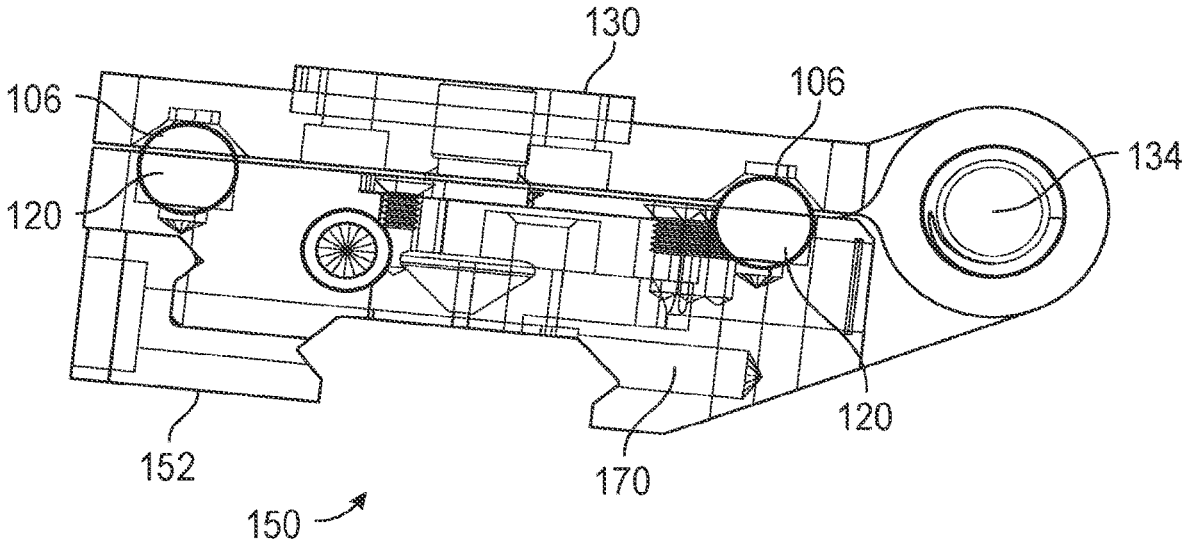
FIG. 7 is a second side transparent view of a kinematic mount assembly in a closed position according to one or more examples of the disclosure.

The plurality of recesses 106 can be formed of different shapes configured to guide the plurality of protrusions 120 into an engaged position shown in FIG. 6 inside the recesses. For example, the plurality of recesses 106 can take the shape of gothic arches or cups. The recesses 106 can go as far into the pivot mount 102 or fixed mount 104 as required by the protrusion 120 shape. In some examples, the recesses 106 may extend through the pivot mount 102 outer surface or fixed mount 104 outer surface.

The outer surface of the pivot mount 102 outer surface can further comprise cavities 110 for mounting an accessory thereupon. For example, these cavities 110 can comprise screw mounts, clips, latches, or other mechanisms to secure an accessory to the pivot mount 102. These cavities 110 may or may not extend fully through the surface of the plate, may or may not extend through the outer surface of the pivot mount, and may or may not extend through the inner surface of the pivot mount. If the plate 130 is present in the embodiment, the cavities 110 in the plate 130 may align with cavities 110 in the outer surface of the pivot mount 102, providing a deeper mounting area and a more secure attachment for an accessory.

In some embodiments, a latch pin 112 is coupled to the inner surface of the pivot mount 102. The latch pin can comprise a shaft 164 and a head 162, wherein the latch pin 112 is configured to removably engage with a latch assembly inside the fixed mount 104. The head 162 can be multiple shapes, such as conical, bulbous or spherical, to removably couple with the latch assembly. In addition, the shaft 164 can comprise an indented ring for the latch 128 to secure therein.

Cavities 114 on the movable extension of the fixed mount 104 may extend through the movable extension 152, across the mounting slot 150, and align with bores 170 on the rear side of the fixed mount. The cavities 114 and bores 170 are configured to further secure the fixed mount 104 to a rail or other part of a gun where accessories may be mounted. These cavities 114 and bores 170, for example, may be configured to secure the fixed mount with screws or pins.

The latch switch 116 is configured to act upon the latch assembly. The latch assembly may comprise any number of pieces configurable to secure the pivot mount to the fixed mount via a removably engageable piece. In one embodiment, the latch assembly comprises an aperture 128 in the center of the fixed mount configurable for the latch pin 112 to fit through. Inside the aperture 128 is a latch 126 configurable to removable engage the latch pin 112. The latch switch 116 is configured to actuate the latch 126 from an engaged position to a disengaged position or vice versa, allowing either the securing or removal of the pivot mount to the fixed mount. The latch switch 116 may be coupled to the fixed mount 104 or the rest of the latch assembly through a shoulder screw 142. In one embodiment, a spring plunger 144 pushes the switch back into a position after actuating the switch.

The latch assembly is covered by a latch plate 118. The latch plate 118 may be flush with the inner surface of the fixed mount or slightly raised so as not to interfere with the protrusion 120 and recess 106 pairings. The latch plate 118 may be secured to the inner surface of the fixed mount 104 by screws, pins, or adhesives.

The plurality of protrusions 120 may be secured to the inner surface of either the fixed mount 104, pivot mount 102, or a combination of the two. The protrusions 120 on one mount will correspond with a recess 106 on the other mount such that a plurality of protrusions 120 are guided by the recesses 106 into a set position within the recesses to move the pivot mount into a repeatable position, allowing the accessory to return to a repeatable position upon moving the pivot mount from a closed position to an open position and back to a closed position. The plurality of protrusions 120 can be of the same or of a different material as the rest of the kinematic mount 100 to better endure the contact wear of repeated use. For example, the protrusions can comprise steel, titanium, or an alloy. In some embodiments, the plurality of protrusions are arranged in a triangular shape to allow control of adjustment of the pivot mount in all six directions: up, down, left, right, forward and backward. The plurality of protrusions 120 can be formed by any number of methods including, but not limited to, molding, welding, drilling, or heating the mount to expand the holes, inserting the protrusion, and allowing the mount to cool around the protrusion. The plurality of protrusions 120 can be any number of shapes configured to adjust the pivot mount into a repeatable position by moving along the recess. For example, the protrusions may be semispherical ball shaped or shaped like cones. In some embodiments, the protrusions are semispherical ball shaped and recesses are gothic-arch shaped.

The first slot of the fixed mount 122 may be on the back side of the fixed mount 104. The first slot of the fixed mount 122 and first slot of the pivot mount 124 together as a pair form a coupling slot. In some embodiments, the first slot of the pivot mount 124 or first slot of the fixed mount 122 can function as a hard stop to prevent over rotation of the pivot mount 102. For example, the first slot of the pivot mount 124 can comprise a bump on the outside of the first slot, configured to wedge or contact the fixed mount to stop rotation at a set point. In another example, a first slot of the fixed mount 122 can comprise a bump to contact the pivot mount to stop rotation at a set point. In some embodiments, this set point is when the pivot mount 102 is 90° to the fixed mount 104. The first slot of the fixed mount 122 and the first slot of the pivot mount 124 may further comprise a pin assembly extending there through to rotatably couple the fixed mount 104 and pivot mount 102. The fixed mount 104 and pivot mount 102 can comprise a second slot of the fixed mount and second slot of the pivot mount to form a second coupling slot. The pin assembly can extend through second coupling slot as well, or a second pin assembly can be provided for the second coupling slot.

The pin assembly can comprise a pivot pin spring 132, a pivot pin 134, a pivot spring plug 136, and keyhole 138. The pivot assembly may have a "clearance" or gap in the area surrounding the outside of the pin assembly, the first slot of the pivot mount 124 and first slot of the fixed mount 122. This "clearance" allows for the pivot mount to be adjusted into the repeatable position by the recesses 106 guiding the protrusions 120 into place. In one embodiment, a first pin assembly and a second pin assembly are used to rotatably couple the pivot mount 102 to the fixed mount 104. In such an embodiment, multiple coupling slots 122, 124 are provided, and the clearance of each coupling slot can be adjusted to provide for better repeatability of the position of the pivot mount.

The pivot pin spring 134 can further comprise a key configured to fit into the keyhole 138 when the pin is compressed. This internal keyhole mechanism is one example of a hard stop of the pivot mount 102. As the pivot mount 102 rotates, the pivot spring 132 is compressed to a compressed position due to the pivot spring plug 136 preventing free rotation of the pivot spring 132. The compression of the pivot spring pushes the pivot pin 134 and key into the notch of the keyhole 138 which then prevents further rotation in that direction.

The rear surface of the fixed mount 104, below the first slot of the fixed mount 122, can further comprise chambers 140. This chamber can provide access to the latch 126, for example, in the event of a jam or malfunction of the switch 116. These chambers 140 may extend through the rear surface of the fixed mount 104 and form indents in the latch 126.

The fixed mount 104 further comprises a mounting slot 150. This mounting slot 150 is of such a size, shape, and configuration to couple to a rail or other piece of a firearm suitable for mounting an accessory. The size of the mounting slot 150 can be adjusted by sliding the movable extension 152 to expand or contract the mounting slot. In some configurations, the mounting slot is dovetail shaped. Dovetail cuts comprise mortises on the receiving portion and tenons in the insertable portion. When the mounting slot 150 is a dovetail slot, the movable extension 152 allows movement of one of the mortices to couple with a tenon on a rail or other piece of a firearm.

In one example, the accessory is an optic. The optic is mounted with screws that extend through the holes 110 on the plate 130, the holes extending into the outer surface of the pivot mount. The fixed mount 104 is then secured onto the dovetail shaped rail of a firearm by sliding the movable extension 152 to ensure the dovetail slot 150 is the proper size to couple with the rail of the firearm. Screws are then inserted through the cavities 114, through the rail of the firearm, and into bores 170 to secure the kinematic mount 100 to the firearm. The optic can then be sighted with the kinematic mount 100 in a closed configuration. Once the optic is sighted properly, the kinematic mount can be opened by disengaging the latch 126 from the latch pin 112 by actuating the switch 116. The pivot mount 102 then rotates around the pin assembly relative to the fixed mount 104 to put the kinematic mount 100 in an open position. As the pivot mount rotates, the pivot spring 132 compresses the pivot spring collar 136 and pushes the key into the keyhole 138, which prevents over rotation. The pivot mount 102 can then be rotated toward the fixed mount 104 to place the kinematic mount 100 in a closed configuration. As the kinematic mount 100 closes, the plurality of recesses 106 guide the plurality of protrusions 120 into a position within the recesses, which adjusts the pivot mount 102 into the same closed position it was in originally. The pivot mount is able to adjust in all 6 directions (up, down, left, right, forward, and backward) because of the clearance in the pin assembly between the pivot pin 134 and the coupling slot of the mounts. This repeatable position means the optic does not have to be re-sighted. In one example scenario, using a Voodoo-M scope wherein the plurality of protrusions 120 comprises three semispherical balls arranged in a triangular shape, and wherein the recesses 106 are three gothic-arch shaped recesses, this embodiment allowed for 1 Minute accuracy at 100 yards and allows for a lower clearance on the hinge. With multiple hinges held by pin assemblies, these clearances can be further adjusted.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A mount assembly for a firearm, the mount assembly comprising:

a fixed mount;

a moveable mount movably coupled to the fixed mount;

a latch movably coupled to one of the fixed mount or the moveable mount, the latch comprising a first latch portion disposed inside the one of the fixed mount or the moveable mount and a second latch portion disposed outside of the one of the fixed mount or the moveable mount;

a latch pin extending from another of the fixed mount or the moveable mount, wherein the first latch portion is configured to engage the latch pin when the mount assembly is in a closed configuration; and a switch movably coupled to the one of the fixed mount or the moveable mount and disposed outside of the one of the fixed mount or the moveable mount;

wherein the switch is configured to selectively engage the second latch portion to actuate the latch from an engaged position to a disengaged position.

2. The mount assembly of claim 1, wherein the moveable mount is rotatably coupled to the fixed mount and configured to rotate relative to the fixed mount between the closed configuration and an open configuration.

3. The mount assembly of claim 2, wherein the moveable mount is rotatably coupled to the fixed mount via a pin assembly.

4. The mount assembly of claim 3, wherein the pin assembly comprises:

a pivot pin insertable into a first hinge portion of the moveable mount and insertable into a first hinge portion of the fixed mount; and a spring disposed around the pivot pin and configured to compress upon rotation of the moveable mount relative to the fixed mount.

5. The mount assembly of claim 1, wherein the moveable mount comprises a plurality of holes configured to mount an accessory to the moveable mount.

6. The mount assembly of claim 5, wherein the accessory is an optic.

7. The mount assembly of claim 1, wherein the fixed mount is configured to mount the mount assembly to the firearm.

8. The mount assembly of claim 7, wherein the fixed mount comprises:

a mounting slot configured to receive a portion of the firearm therein; and a moveable extension configured to adjust a dimension of the mounting slot.

9. The mount assembly of claim 1, wherein the latch is configured to move relative to the one of the fixed mount or the moveable mount within a first plane, and wherein the switch is configured to move relative to the one of the fixed mount or the moveable mount within a second plane extending transverse to the first plane.

10. The mount assembly of claim 1, wherein the latch is movably coupled to the fixed mount, wherein the latch pin extends from the fixed mount, and wherein the switch is movably coupled to the fixed mount.

11. The mount assembly of claim 1, further comprising:

a latch plate covering the first latch portion and defining an aperture, wherein the aperture is configured to allow the latch pin to pass therethrough.

12. The mount assembly of claim 1, further comprising:

a plurality of protrusions disposed on the fixed mount or the moveable mount; and a plurality of recesses disposed on the fixed mount or the moveable mount, wherein the plurality of recesses is configured to move the moveable mount into a repeatable position by guiding the plurality of protrusions into a set position within the plurality of recesses.

13. The mount assembly of claim 12, wherein the plurality of protrusions are semispherical balls, and wherein the recesses are gothic-arch shaped.

14. The mount assembly of claim 12, wherein the plurality of protrusions comprises three protrusions arranged in a triangular shape, and wherein the plurality of recesses comprises three recesses arranged in a triangular shape.

15. A mount assembly for a firearm, the mount assembly comprising:

a fixed mount configured to mount the mount assembly to the firearm;

a moveable mount movably coupled to the fixed mount and configured to mount an accessory to the moveable mount;

a latch movably coupled to the fixed mount, the latch comprising a first latch portion disposed inside the fixed mount and a second latch portion disposed outside of the fixed mount;

a latch pin extending from the moveable mount, wherein the first latch portion is configured to engage the latch pin when the mount assembly is in a closed configuration; and a switch movably coupled to the fixed mount and disposed outside of the fixed mount;

wherein the switch is configured to selectively engage the second latch portion to actuate the latch from an engaged position to a disengaged position.

16. The mount assembly of claim 15, wherein the moveable mount is rotatably coupled to the fixed mount via a pin assembly and configured to rotate relative to the fixed mount between the closed configuration and an open configuration.

17. The mount assembly of claim 15, wherein the latch is configured to move relative to the fixed mount within a first plane, and wherein the switch is configured to move relative to the moveable mount within a second plane extending transverse to the first plane.

18. The mount assembly of claim 15, further comprising:

a latch plate covering the first latch portion and defining an aperture, wherein the aperture is configured to allow the latch pin to pass therethrough.

19. The mount assembly of claim 15, further comprising:

a plurality of protrusions disposed on the fixed mount or the moveable mount;

a plurality of recesses disposed on the fixed mount or the moveable mount, wherein the plurality of recesses is configured to move the moveable mount into a repeatable position by guiding the plurality of protrusions into a set position within the plurality of recesses.

20. A method of manufacturing a mount assembly for a firearm, the method comprising:

providing a fixed mount;

providing a moveable mount movably coupled to the fixed mount;

providing a latch movably coupled to one of the fixed mount or the moveable mount, the latch comprising a first latch portion disposed inside the one of the fixed mount or the moveable mount and a second latch portion disposed outside of the one of the fixed mount or the moveable mount;

providing a latch pin extending from another of the fixed mount or the moveable mount, wherein the first latch portion is configured to engage the latch pin when the mount assembly is in a closed configuration; and providing a switch movably coupled to the one of the fixed mount or the moveable mount and disposed outside of the one of the fixed mount or the moveable mount;

wherein the switch is configured to selectively engage the second latch portion to actuate the latch from an engaged position to a disengaged position.

* * * * *